United States Patent [19]

Müller

[11] Patent Number: 4,525,313

[45] Date of Patent: Jun. 25, 1985

[54] PROCESS AND APPARATUS FOR PRODUCING SINGLE- OR MULTI-BASE PROPELLANTS

[75] Inventor: Dietmar Müller, Karlsruhe, Fed. Rep. of Germany

[73] Assignee: Fraunhofer-Gesellschaft zur Forderung der angewandten Forschung e.V., Munich, Fed. Rep. of Germany

[21] Appl. No.: 548,356

[22] Filed: Nov. 3, 1983

[30] Foreign Application Priority Data

Nov. 16, 1982 [DE] Fed. Rep. of Germany ..... 3242301

[51] Int. Cl.[3] ..... C06B 21/00

[52] U.S. Cl. ..... 264/3 B; 149/96; 149/97; 149/109.6; 425/131.1

[58] Field of Search ..... 264/3 B; 149/96, 97, 149/109.6; 425/131.1

[56] References Cited

U.S. PATENT DOCUMENTS

| | | | |
|---|---|---|---|
| 3,897,733 | 8/1975 | Stiefel et al. | 264/3 B |
| 3,904,719 | 9/1975 | Fritsch | 264/176 R |
| 3,968,955 | 7/1976 | Fritsch | 264/176 R |
| 4,354,884 | 10/1982 | Williams | 264/3 B |
| 4,444,606 | 4/1984 | Bertrand et al. | 264/3 C |

*Primary Examiner*—Stephen J. Lechert, Jr.
*Attorney, Agent, or Firm*—McCormick, Paulding & Huber

[57] ABSTRACT

Single- or multi-base propellants are produced in a solvent process from their starting components, of which at least one is moistened with alcohol, using a twin-shaft screw extruder, that has an inlet zone run at a raised temperature, then nextly a mixing and kneading zone and lastly an outlet zone. The temperature in the kneading and mixing zone and in the outlet zones is kept at a value that is higher than in the inlet zone. Furthermore there is a temperature drop towards the outlet zone.

15 Claims, 2 Drawing Figures

PROCESS AND APPARATUS FOR PRODUCING SINGLE- OR MULTI-BASE PROPELLANTS

BACKGROUND OF THE INVENTION

The present invention is with respect to a process and an apparatus for the production of single-base and multi-base propellant in the form of rods using a double shaft screw extruder with an intake zone for the starting components, of which at least one is moistened with alcohol, and next thereto a mixing and kneading zone with means for the addition of solvent for plastifying the material and an outlet zone after the said screws with a forming head for one or more rods, the said intake zone being kept at a raised temperature.

For the production of single-base propellants (nitrocellulose), double-base propellants (nitrocellulose+nitroglycerin or other liquid explosive), and furthermore triple-base propellants (nitrocellulose+nitroglycerin+-nitroguanidine), thermoplastic molding processes or more specially molding processes using volatile solvent are used. The solvent or gelling agents are as a rule ketones, alcohols, ethers or mixtures thereof. The solvent process outdoes the thermoplastic molding or forming method on safety grounds inasfar as the addition of the solvents makes for a relatively low working temperature, and for example nitrocellulose that has been turned into a doughy mass in this way may be extruded from a screw extruder as one or more rods (see German Auslegeschrift specification No. 2,825,567 and the German Offenlegungsschrift specification No. 3,044,577), in which respect, dependent on the field of use one or more needle cores are used in the die so that the rods are formed with one or more holes therein.

Because of internal friction high temperatures are produced in such molding processes, so that in the past attempts have been at keeping the apparatus cool by the addition of excess solvent or by cooling the extruder in the kneading or mixing zone (see said German Auslegeschrift specification No. 2,825,567) so as to keep the temperature within safe limits. In the first case of the addition of excess solvent the extrude has to undergo a drying process for clearing the rest of the solvent therefrom before it may undergo further processing. In this case as well the material does not in all cases keep its shape and the holes therein may be changed in form in an undesired way. In both the two said cases the quality of the final product is not good enough, more specially in respect of density and homogeneity. It is however these very factors, namely dimensional stability, density and homogeneity, that are likely to have a very marked effect on the ballistic properties. Although with the controlled addition of solvent (as in the said German specification No. 3,044,577) very much better effects are possible, the throughput rate is not as desired.

GENERAL OVERVIEW OF THE PRESENT INVENTION

One purpose of the present invention is that of designing a process and an apparatus that make it possible for propellant to be produced with a homogeneous nature in dimensionally stable rods.

A further purpose or object of my invention is to make it possible for such materials to be produced with a higher throughput rate.

Taking into account the prior art processes noted hereinbefore, in which a double-shaft screw extruder has an intake zone run at a raised temperature, these and other purposes are to be effected in the invention by a process in which the kneading and mixing zone and the outlet zone are kept at a constant temperature that is higher than the temperature of the intake zone.

The invention may be looked upon as being based on the idea that the system of cooling used in the prior art downstream from the heated intake zone has been responsible for layers being formed on the inner face of the extruder housing so that between the face and the layers of product next thereto shearing forces are produced that are the cause of uncontrolled increases in temperature in the mass being worked, such forces being in addition to the mixing and kneading forces. These effects would seem to be responsible for the final product not turning out to be homogeneous. Under working conditions this is furthermore the cause of plugs being formed inside the extruder so that the product does not come out of the extruder evenly. Although in the past attempts have been made at keeping back such plugs or unhomogeneous bodies by putting in sieves upstream from the outlet die (see German Offenlegungsschrift specification No. 3,042,662), the sieves very quickly became stopped up so that the extruder has to be frequently taken to pieces for cleaning.

By undertaking the process as in the present invention the said undesired effects are put an end to. At the raised temperatures in the kneading and mixing zones a better gel structure, and for this reason better rheological properties are produced, which may be taken to be responsible for the better homogeneity that has been noted. Although for safety reasons, cooling of the extruder would seem called for, tests run under working conditions have made it clear that the process may be certainly undertaken above ground at raised temperatures, although such temperatures do have to be kept under the evaporation temperature of the solvents. Furthermore the throughput rate may be markedly stepped up.

In order to keep down the otherwise increased danger, when producing double-base or multi-base propellant, in the invention the kneading the mixing zone is temperaturewise cut up into sections within each of which the temperature is constant but in the case of which the temperature goes down from one section to the next in the direction of motion of the material.

This being the case, the product makes its way through the apparatus in the intake zone through a section with a raised temperature, in the first part of the kneading and mixing zone through a section with a still higher temperature and then nextly through sections with a decreasing temperature, same however being still higher than the temperature in the intake zone.

For the production of single-base propellant with a small amounts or liquid explosives and dinitrotoluene, it is possible, in keeping with a further, preferred developpment of the present invention, for the housing temperature in the part of the extruder with the screw in the intake zone to be kept at 40±3° C. and in the kneading and mixing zone at 56±3° C. whereas in the outlet zone it is so controlled that the temperature of the product is 64±3° C.

For the production of multi-base, and more specially three-base propellants, in keeping with a preferred form of the invention it is possible for the housing temperature near the screw in the intake zone to be kept at 35±5° C. and then to go down from 50±3° C. in the kneading and mixing zone in the direction of product motion to 45±3° C. and in the outlet zone to go down to 40±3° C.

For running the process of the present invention double shaft extruders may be used, and when processing single-base propellants the relative direction of the screws is unimportant so that they may be turned in the same or opposite directions while in the case of multi-base propellants it is best for the screws to be run in the same direction. In the case of a further preferred form of the screw extruder for single-base propellant a certain equation may be used for the design of the size of the length and diameter, that is to say, between the length L (length overall less the length of the outlet zone) and the inner diameter D of the housing:

| | |
|---|---|
| (a) Screw direction the same, length overall | L = 23D |
| Intake zone (40 ± 3° C.) | $L_1$ = 9D |
| Mixing and kneading zone (56 ± 3° C.) | $L_2$ = 14D |
| (b) Screw direction opposite, length overall | L = 26D |
| Intake zone (40 ± 3° C.) | $L_1$ = 11D |
| Mixing and kneading zone 56 ± 3° C.) | $L_2$ = 15D |

In keeping with a preferred form of the invention, for a twin screw extruder for multi-base or more specially three-base propellants and with a length overall (L) of 23D with the addition of the length of the outlet zone the equations for other zones are to be generally

| | |
|---|---|
| Intake zone (35 ± 5° C.) | $L_1$ = 5D |
| First kneading and mixing zone (50 ± 3° C.) | $L_2'$ = 9D |
| Second kneading and mixing zone (45 ± 3° C.) | $L_2'$ = 9D |

In both of these forms of the invention no very important part is played by the length of the outlet zone, because it is in all cases of more or less the same length. In this respect the only point to be kept a watch on is that the process is run within the temperature limits given in the processes noted.

In all forms of the invention it is best if the housing has one or more gas letoff openings, more specially at the mixing and kneading zone, so that the evaporating solvents may be let off and more importantly no pockets of gas or bubbles are formed in the product. In this connection in all forms of the invention the housing of the screw extruder is to have a fluid circuit that is under thermostatic control to make certain that by cooling or heating the desired constant temperature limits are kept to in the separate zones.

EXAMPLE 1

For producing single-base propellant 100 kg (dry weight) of nitrocellulose moistened with 25 to 30 kg of alcohol, about 1.7 to 2% by weight of stabilizer and sodium oxalate were worked up with 16.5 to 27 kg of acetone in an extruder with the screws running in the same or opposite directions. In the intake zone the housing temperature ($t_1$) next to the wall of the extruder was 40±3° C. and the temperature ($t_2$) in the kneading mixing zone was 56±3° C., whereas the temperature ($t_3$) of the product in the outlet part was 64±3° C. The speed of turning of the screw shafts was at 20 to 120 rpm for multi-rod extrusion, the rods being produced with one or more holes therein by using needle dies so that the extrudes had the normal geometry.

The extrudes so produced were transparent with a smooth surface and at once were able to be cut up and the processed on their surfaces without any further drying operation and without any loss of dimensional stability.

EXAMPLE 2

For producing a three-base propellant 100 kg (dry weight) of a premix made up of 47±1% by weight of nitroguanidine, 28±1% by weight of nitrocellulose, 23±1% by weight of nitroglycerin, 1.5±0.1% by weight of stabilizer, about 0.3% by weight of cryolite, 6 to 8 kg of alcohol and 18 to 22 kg of acetone were worked in an extruder with its screws turning in the same direction. The housing temperature ($t_1$) in the intake and metering zone was 35±5° C., in a first section of the mixing and kneading zone the temperature ($t_2'$) was kept at 50±3° C. and in a second section of the kneading and mixing zone the temperature ($5_2''$) was kept at 45±3° C., whereas in the outlet zone the housing temperature ($t_3$) was kept at 40±3° C., the product temperature being 62±5° C. The speed of the screws was 20 to 120 rpm and the product was extruded in more than one rod with one or more holes in each rod.

Single component metering into the extruder would be possible as well, the nitroglycerin and then being desensitized with the nitrocellulose. In this case as well 18 to 22 kg of acetone were needed for plastifying.

A detailed account will now be given of two working examples of the invention using the figures.

LIST OF THE DIFFERENT VIEWS OF THE FIGURES

DETAILED ACCOUNT OF WORKING EXAMPLES OF THE INVENTION

Figure 1:
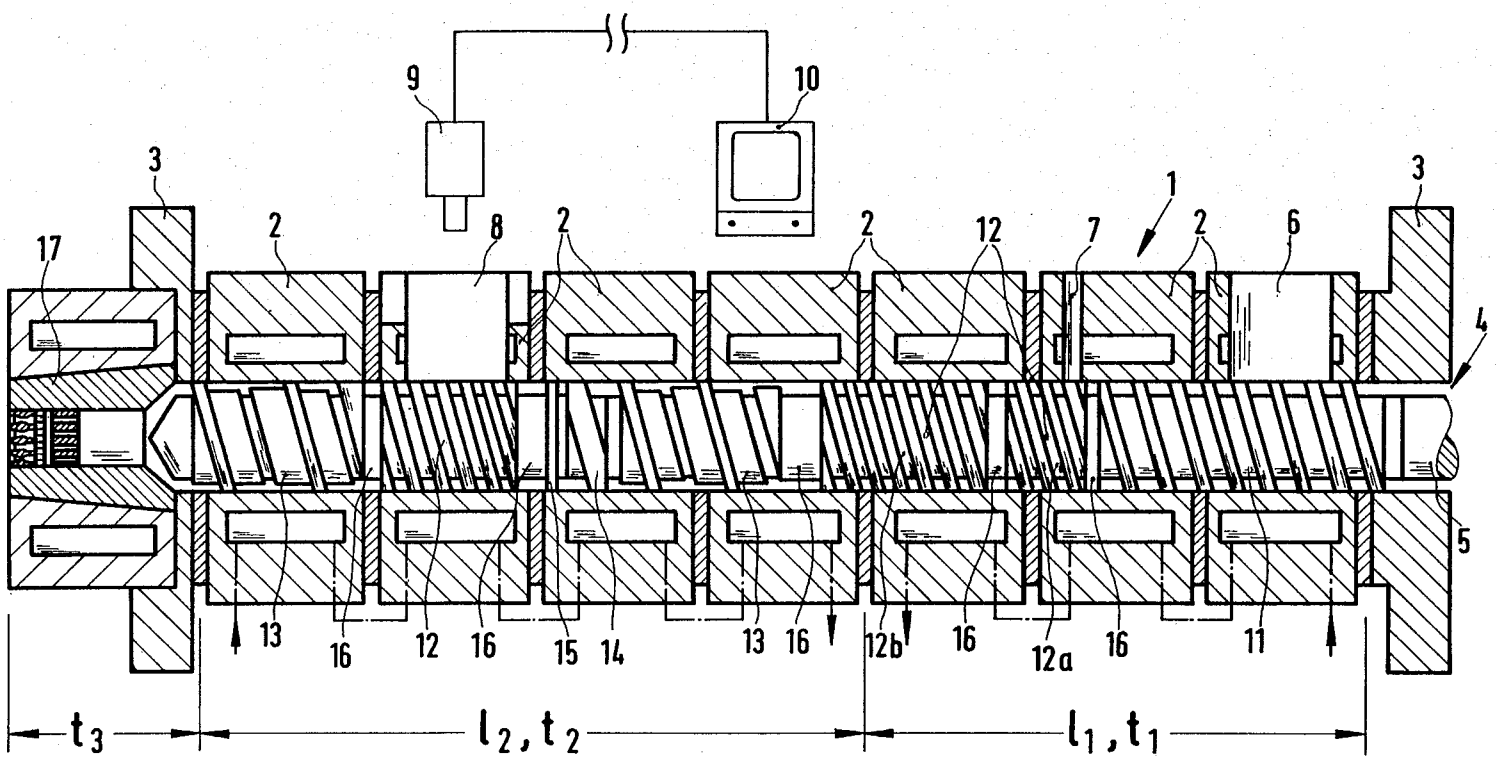
FIG. 1 is a diagrammatic lengthways section through a twin shaft extruder whose screws are run in opposite directions.

The extruder to be seen in FIG. 1 has a housing made up of a number of segments 2 having end flanges 3 joining them together. At the driving end 4 it will be seen that there are two parallel oppositely turning screw shafts 5 running into the housing, such shafts stretching as far as the front end flange 3 at which they have pointed ends. The last housing segment 2 is joined to a molding head 17. This screw extruder is used for the production of single-base propellant.

The first housing segment 2, the one at the drive end, has an inlet opening 6 for the solid components, namely nitrocellulose and additives. At this point it is further possible for stabilizers to be put in, all such components being run in separately or in the form of a premix. The next segment 2, coming thereafter in the direction of product motion, has a jet duct 7, through which the solvent, possibly mixed with the stabilizers, is metered into the extruder. Lastly the last but one segment 2 in the direction of motion has an opening 8 that is used on the one hand for letting off gas from the product and on the other hand is used for photooptically recording the condition of the surface of the product as it makes its way past the opening. Over the opening there is a camera 9 joined up with a monitor 10. This monitor is used for controlling the rate of addition of solvent into the extruder by way of the jet duct 7. These parts of the design of an extruder are known in the art, see the said German specification No. 3,044,577.

At their drive ends the two symmetrically designed and placed screw shafts 5 firstly have a pumping or transporting section 11 in which the screw is a single start screw. There is next a further, multi-start part 12*a* and 12*b* of the screw at the jet duct 7. There then comes a first kneading section 13 and a second kneading section 14, after which there is a baffle disk 15. After the baffle plate 15 and right next to the gas letoff and observation opening 8 there is again a three-start transport part 12 of the screw lastly ending in a further kneading section 13 next to the die.

Between the separate transport or pumping sections 12 and between same and the kneading section 13, and the baffle disk 15 there are stabilizing or tranquilizing zones 16 in which there are no pumping elements. The die head 17 is in the figured example made up of a multi-hole die with a perforated plate and dies on the downstream side thereof, said dies having needle supports for producing the holes or channels in the rods.

As will furthermore be seen from the figure the pumping or transporting section 11 and 12 are designed running roughly along and inside the first three housing segments 2, such segments forming the intake zone with the length $L_1$, that is equal to about 11D, with D being the inner diameter of the housing. Within this intake zone a temperature ($t_1$) of 40±3° C. is kept to.

The kneading and mixing zone $L_2$ is formed by the next four housing segments 2, in which a housing temperature ($t_2$) of 56±3° C. is kept to. The length $L_2$ is equal to about 15D. Lastly in the outlet zone with the die the product temperature ($t_3$) is to be kept at 64±3° C.

Figure 2:
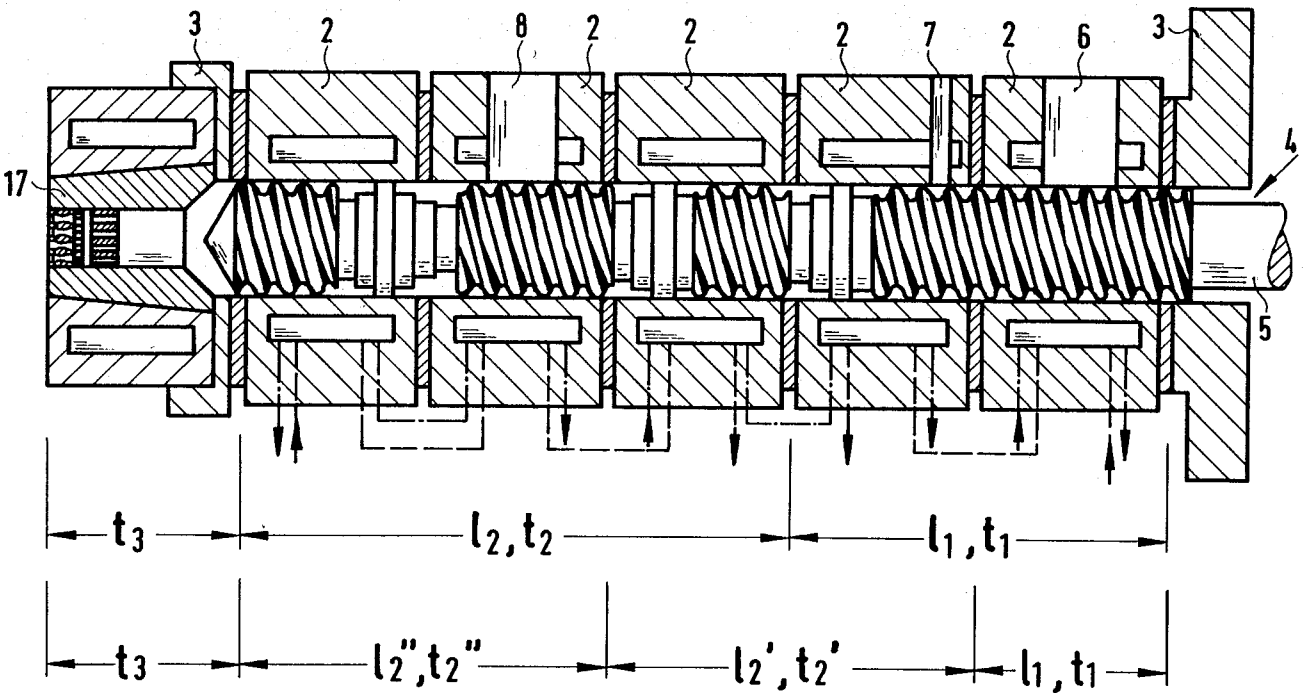
FIG. 2 is a view of a twin shaft extruder whose screws are turned in the same direction.

The extruder to be seen in FIG. 2 with two shafts run in opposite directions again may be of generally known design so that a detailed account thereof is not needed. At the intake zone the screw shafts have sections that are more importantly designed for pumping and conveying and in the next part there are sections that are more specially designed for kneading and mixing, although there may be no clear-cut limits to the separate sections. As was the case with the first form of the invention the gas letoff openings are more specially to be placed in the pumping sections of the screws, the gas letoff opening having been marked in the figure to make this clear.

Right under the figure of the extruder the lengths of the different parts of the process have been marked in the case of use for producing a single-base propellant. In this respect the intake zone $L_1$ with a length roughly equal to 9D is run at a constant temperature ($t_1$) equal to 40±3° C., whereas in the kneading and mixing zone with the length of $L_2$ equal to about 14D the temperature ($t_2$) is kept at 56±3° C. In the outlet part the product temperature of the single-base propellant is 64±3° C. In this case as well the outlet part is formed by a multi-hole die with needle means therein if needed. Furthermore there will in this case as well be at least one gas letoff opening in the kneading and mixing zone $L_2$.

Further down n the said figure the lengths of the different parts of the process on producing a three-base propellant have been marked. Because in this case the temperature is kept at a greater number of different values, the separate zones are not quite the same as the zones noted in connection with the production of a single-base propellant. The intake zone $L_1$ has a length of about 5D and in it the temperature ($t_1$) is kept at 35±5° C. The first section of the kneading and mixing zone $L_2'$ coming thereafter has an inner diameter of about 9D and the temperature is kept constant in at at a value of 50±3° C. After this there is then the further section $L_2''$ of the kneading and mixing zone where the temperature is 45±3° C., this giving a product temperature of 62±5° C. Lastly in the outlet part with the dies the temperature ($t_3$) is kept at 40±3° C.

I claim:

1. A process for producing an at least single-base propellant in rod form using a twin shaft screw extruder with an intake zone for starting components of said propellant, at least one of said components being moistened with alcohol, with a mixing and kneading zone downstream from and next to said intake zone in which solvent is run into said components for plastifying same and with an outlet zone downstream from said kneading and mixing zone, said outlet zone being next to screw means of said extruder and having a molding head for forming said components as processed in said extruder into at least one rod, said intake zone being kept at a raised temperature, and said kneading and mixing zone and said outlet zone being kept at a generally constant temperature that is greater than the temperature of the inlet zone.

2. The process as claimed in claim 1 for producing at least double-base propellant, wherein in said kneading and mixing zone at least two sections are each kept at a temperature that is constant within said section, the temperature of the product going down from one such section to the next thereof in the direction of motion of said product through said extruder.

3. The process as claimed in claim 1 for producing single-base propellant wherein at said intake zone the temperature of a housing part near a screw thereof is kept at a value of 40±3° C., in the kneading a mixing zone it is kept at 56±3° C. and in the outlet zone it is kept at such a value that the temperature of the components is equal to 64±3° C.

4. The process as claimed in claim 2 for producing at least single base propellant wherein at said intake zone the temperature of a housing part near a screw thereof is kept at a value of 35±5° C., in the kneading a mixing zone it is kept at between 50±3° C. and 45±3° C. and in the outlet zone it is equal to 40±3° C.

5. The process as claimed in claim 4 wherein there is a temperature drop in the mixing and kneading zone in the downstream direction from 50±3° C. to 45±3° C.

6. The process as claimed in claim 4 wherein said propellant produced is a three-base propellant.

7. An apparatus for producing an at least single-base propellant in rod form comprising a twin shaft screw extruder having a housing, screw means in said housing in which components for making said propellant may be pumped by said screw means, said housing walling in an intake zone for starting components of said propellant, a mixing and kneading zone downstream from and next to said intake zone, said mixing zone being adapted for the addition of solvent into said components for plastifying same, and an outlet zone downstream from said kneading and mixing zone, said outlet zone having a molding head for forming said components as processed in said extruder into at least one rod, means for keeping said intake zone at a raised temperature, and means for keeping said kneading and mixing zone and said outlet zone at a generally constant temperature that is greater than the temperature of the inlet zone.

8. The apparatus as claimed in claim 7 wherein said screw means is in the form of two screws and of means for turning the same in opposite directions.

9. The apparatus as claimed in claim 7 wherein said screw means is in the form of two screws and means for turning them in the same direction.

10. The apparatus as claimed in claim 7 wherein said heating means is designed for so heating the housing that while producing single-base propellant at said intake zone the temperature of a housing part near said screw means of said extruder is kept at a value of 40±3° C., in the kneading and mixing zone it is kept at 56±3° C. and in the outlet zone it is kept at such a value that the temperature of the components is equal to 64±3° C., said screw means having oppositely turning screws.

11. The apparatus as claimed in claim 8 for producing single-base propellant wherein the screw means is in the form of two screws turning in the same direction and the connection between the overall length of less the length of the outlet zone (herein named L) and the inner diameter (herein named D) is:

| | |
|---|---|
| Screw direction the same, length overall | L = 23D |
| Intake zone (40 ± 3° C.) | $L_1$ = 9D |
| Mixing and kneadlng zone (56 ± 3° C.) | $L_2$ = 14 |

12. The apparatus as claimed in claim 8 for producing single-base propellant wherein wherein the screw means is in the form of two screws turning in opposite directions and the connections between the overall length less the length of the outlet zone (herein named L) and the inner diameter (herein named D) is:

| | |
|---|---|
| Screw direction opposite, length overall | L = 26D |
| Intake zone (40 ± 3° C.) | $L_1$ = 11D |
| Mixing and kneading zone (56 ± 3° C.) | $L_2$ = 15D |

13. The extruder as claimed in claim 8 for producing three-base propellant wherein in the case of an overall length of the screw means made up of screws turning in the same direction of 23 times the inner diameter of the housing, with the addition of the length of the outlet zone the connections between the lengths of the separate zones and the temperatures thereof are:

| | |
|---|---|
| Intake zone (35 ± 5° C.) | $L_1$ = 5D |
| First kneading and mixing zone (50 ± 3° C.) | $L_2'$ = 9D |
| Second kneading and mixing zone (45 ± 3° C.) | $L_2'$ = 9D |

14. The extruder as claimed in claim 7 wherein said housing has at least one gas letoff opening.

15. The extruder as claimed in claim 10 wherein the at least one gas letoff opening is placed in the mixing and kneading zone.

* * * * *